US011568850B2

(12) United States Patent
Wu

(10) Patent No.: US 11,568,850 B2
(45) Date of Patent: Jan. 31, 2023

(54) SOUND INPUT AND OUTPUT SYSTEM AND NOISE CANCELLATION CIRCUIT

(71) Applicant: REALTEK SEMICONDUCTOR CORPORATION, Hsinchu (TW)

(72) Inventor: Mu-Chen Wu, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 17/552,313

(22) Filed: Dec. 15, 2021

(65) Prior Publication Data

US 2022/0254327 A1 Aug. 11, 2022

(30) Foreign Application Priority Data

Feb. 5, 2021 (TW) ..... 110104398

(51) Int. Cl.
*G10K 11/178* (2006.01)

(52) U.S. Cl.
CPC ..... *G10K 11/17853* (2018.01); *G10K 2210/3028* (2013.01)

(58) Field of Classification Search
CPC ..... G10K 11/1785; G10K 11/17853; G10K 11/17854; G10K 2210/3028; G10K 2210/3056; G10K 2210/505
See application file for complete search history.

(56) References Cited

U.S. PATENT DOCUMENTS 8,718,291 B2 5/2014 Alves et al.
10,580,398 B2 * 3/2020 Cattell ..... G10K 11/178
2012/0308024 A1 * 12/2012 Alderson ..... G10K 11/17855 381/71.11

OTHER PUBLICATIONS

Morgan et al. "A Delayless Subband Adaptive Filter Architecture", August 8m 1995. Transactions on Signal Processing, vol. 43, IEEE.
Wu et al. "A Simplified Adaptive Feedback Active Noise Control System", Mar. 21, 2014 Elsevier Ltd.
Kuo et al. "Active Noise Control_A Tutorial Review", Jun. 6, 1999, Proceedings of the IEEE, vol. 87, IEEE.
Ardekani et al. "FxLMS-based Active Noise Control A Quick Review", 2011, Apsipa ASC Xi'an, China.
Wade et al. "Enhancement of Residual Echo for Robust Acoustic Echo Cancellation", Jan. 2012, Transactions on Audio Speech and Language Processing, vol. 20, IEEE.

* cited by examiner

*Primary Examiner* — Kile O Blair
(74) *Attorney, Agent, or Firm* — WPAT, PC

(57) ABSTRACT

A noise cancellation circuit includes: a first filter circuit for filtering a first input signal according to a first filter coefficient to generate a first filtered signal; a signal processing circuit for generating a feedback signal according to a second input signal and an audio signal; a second filter circuit for filtering the feedback signal according to a second filter coefficient to generate a second filtered signal; a first multiplication circuit for multiplying the first filtered signal by a first scale to generate a first intermediate signal; a second multiplication circuit for multiplying the second filtered signal by a second scale to generate a second intermediate signal; a first adder circuit for adding the first intermediate signal to the second intermediate signal to generate a noise cancellation signal; and a second adder circuit for adding the noise cancellation signal to the audio signal to generate an output signal.

20 Claims, 10 Drawing Sheets

SOUND INPUT AND OUTPUT SYSTEM AND NOISE CANCELLATION CIRCUIT

BACKGROUND OF THE INVENTION

1. Field of the Invention

The present invention generally relates to noise cancellation, and, more particularly, to hybrid active noise cancellation.

2. Description of Related Art

FIG. 1 shows a conventional sound input and output system with a hybrid noise cancellation function. The sound input and output system 10 includes a microphone 11, a microphone 12, a speaker 13, a filter circuit 14, a filter circuit 15, a filter circuit 16, an adder circuit 17, an adder circuit 18, and an adder circuit 19.

The microphone 11 receives the first environmental noise and generates the first input signal x. The microphone 12 receives a sound and generates a second input signal e. The sound includes the second environmental noise and the sound outputted by the speaker 13. The sound outputted by the speaker 13 travels to the microphone 12 via the sound propagation path 100.

The filter circuit 14 filters the first input signal x to generate the filtered signal $y_{ff}$. The filter circuit 15 filters the feedback signal f to generate the filtered signal $y_{fb}$. The adder circuit 17 adds the filtered signal $y_{ff}$ and the filtered signal $y_{fb}$ to generate the noise cancellation signal y. The adder circuit 18 adds the noise cancellation signal y and the audio signal v to generate an output signal z. The speaker 13 outputs sound according to the output signal z. The audio signal v can be the music to which the user is listening, or the human voice in a call.

The filter coefficient of the filter circuit 16 can describe the sound propagation path 100, that is to say, the filter circuit 16 is a model that simulates the sound propagation path 100. The filter circuit 16 filters the audio signal v to generate the filtered signal $v_s$ (i.e., $v_s=v*\underline{\hat{s}}$, where $\underline{\hat{s}}$ (the underline of $\underline{\hat{s}}$ indicates that $\underline{\hat{s}}$ is a vector) is the filter coefficient of the filter circuit 16 and can be obtained by measuring the sound propagation path 100 in advance, and the symbol "*" means convolution). The adder circuit 19 subtracts the filtered signal $v_s$ from the second input signal e to generate the feedback signal f. The second input signal e and the feedback signal f can be expressed as:

$$e=(y+v)*\underline{s}+d \tag{1}$$

$$f=y*\underline{s}+d+v*s-v*\underline{\hat{s}} \tag{2}$$

where $\underline{s}$ represents the sound propagation path 100, $(y+v)*\underline{s}$ represents that the output of the speaker 13 travels through the sound propagation path 100, and d represents the second environmental noise.

"Hybrid" means that the noise cancellation signal y contains the feedforward noise cancellation component (i.e., by means of the filtered signal $y_{ff}$) and the feedback noise cancellation component (i.e., by means of the filtered signal $y_{fb}$). When the sound input and output system 10 adaptively performs noise cancellation based on the environmental noises, the filter coefficients of the filter circuit 14 and the filter circuit 15 must be updated frequently. However, the conventional sound input and output system 10 often has the issue that the filter coefficients converge too slowly or the convergence performance is not good.

SUMMARY OF THE INVENTION

In view of the issues of the prior art, an object of the present invention is to provide a sound input and output system and a noise cancellation circuit, so as to make an improvement to the prior art.

According to one aspect of the present invention, a sound input and output system for processing an audio signal and generating an output signal is provided. The sound input and output system includes a sound output device for outputting the output signal; a first sound input device for generating a first input signal; a second sound input device for generating a second input signal; a first filter circuit, coupled to the first sound input device, for filtering the first input signal according to a first filter coefficient to generate a first filtered signal; a signal processing circuit, coupled to the second sound input device, for generating a feedback signal according to the second input signal and the audio signal, wherein the signal processing circuit filters the audio signal to generate a filtered audio signal, and the feedback signal includes a calculation result of the filtered audio signal and the second input signal; a second filter circuit, coupled to the signal processing circuit, for filtering the feedback signal according to a second filter coefficient to generate a second filtered signal; a first multiplication circuit, coupled to the first filter circuit, for multiplying the first filtered signal by a first scale to generate a first intermediate signal; a second multiplication circuit, coupled to the second filter circuit, for multiplying the second filtered signal by a second scale to generate a second intermediate signal; a first adder circuit, coupled to the first multiplication circuit and the second multiplication circuit, for adding the first intermediate signal to the second intermediate signal to generate a noise cancellation signal; and a second adder circuit, coupled to the first adder circuit, for adding the noise cancellation signal to the audio signal to generate the output signal.

According to another aspect of the present invention, a noise cancellation circuit for processing an audio signal and generating an output signal is provided. The noise cancellation circuit includes a first filter circuit for filtering a first input signal according to a first filter coefficient to generate a first filtered signal; a signal processing circuit for generating a feedback signal according to a second input signal and the audio signal, wherein the signal processing circuit filters the audio signal to generate a filtered audio signal, and the feedback signal includes a calculation result of the filtered audio signal and the second input signal; a second filter circuit, coupled to the signal processing circuit, for filtering the feedback signal according to a second filter coefficient to generate a second filtered signal; a first multiplication circuit, coupled to the first filter circuit, for multiplying the first filtered signal by a first scale to generate a first intermediate signal; a second multiplication circuit, coupled to the second filter circuit, for multiplying the second filtered signal by a second scale to generate a second intermediate signal; a first adder circuit, coupled to the first multiplication circuit and the second multiplication circuit, for adding the first intermediate signal to the second intermediate signal to generate a noise cancellation signal; and a second adder circuit, coupled to the first adder circuit, for adding the noise cancellation signal to the audio signal to generate the output signal.

These and other objectives of the present invention no doubt become obvious to those of ordinary skill in the art after reading the following detailed description of the preferred embodiments with reference to the various figures and drawings.

DETAILED DESCRIPTION OF THE EMBODIMENTS

The following description is written by referring to terms of this technical field. If any term is defined in this specification, such term should be interpreted accordingly. In addition, the connection between objects or events in the below-described embodiments can be direct or indirect provided that these embodiments are practicable under such connection. Said "indirect" means that an intermediate object or a physical space exists between the objects, or an intermediate event or a time interval exists between the events.

The disclosure herein includes a sound input and output system and a noise cancellation circuit. On account of that some or all elements of the present invention could be known, the detail of such elements is omitted provided that such detail has little to do with the features of this disclosure, and that this omission nowhere dissatisfies the specification and enablement requirements. A person having ordinary skill in the art can choose components equivalent to those described in this specification to carry out the present invention, which means that the scope of this invention is not limited to the embodiments in the specification.

In the following discussions, m and n are positive integers, representing the time index.

Figure 1:
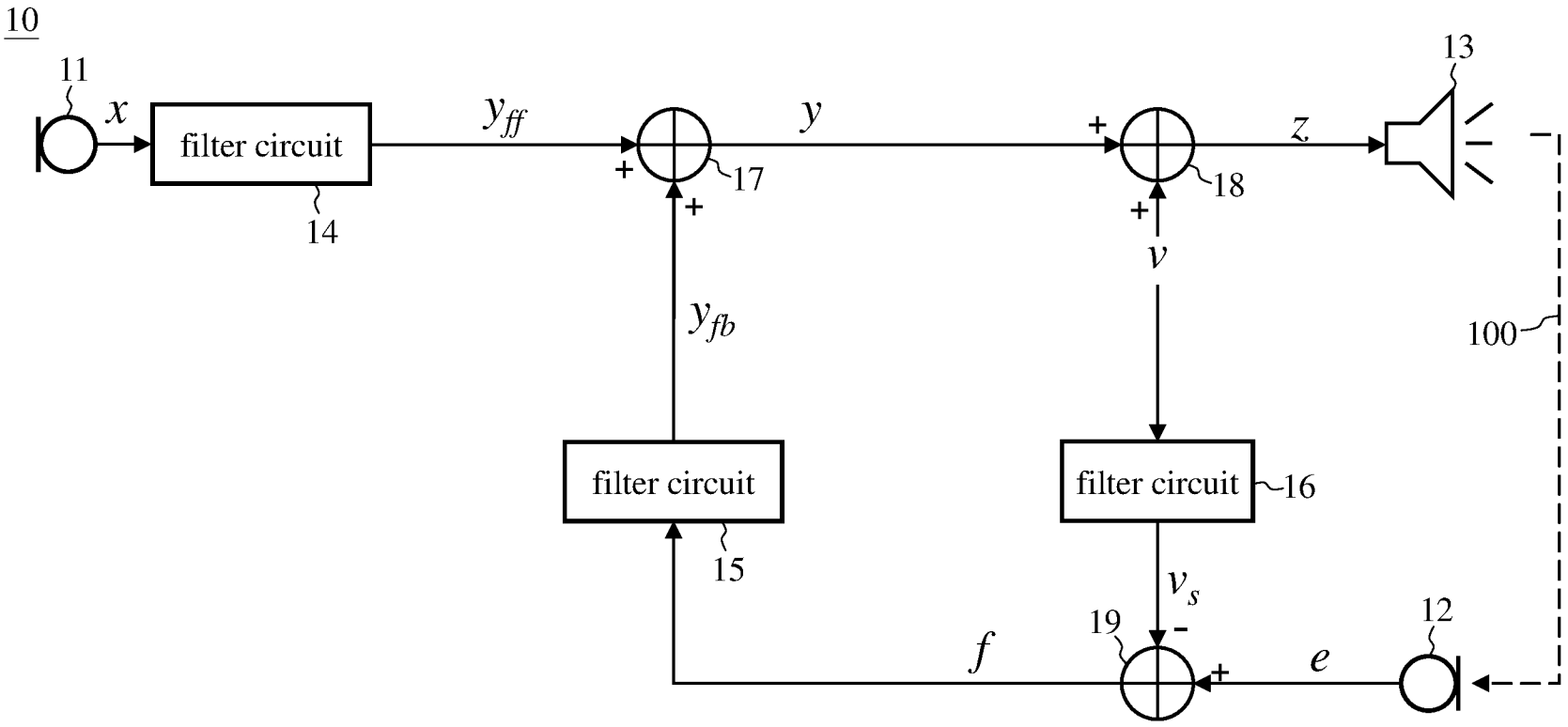
FIG. 1 (prior art)
FIG. 1 shows a conventional sound input and output system with a hybrid noise cancellation function.
Figure 2:
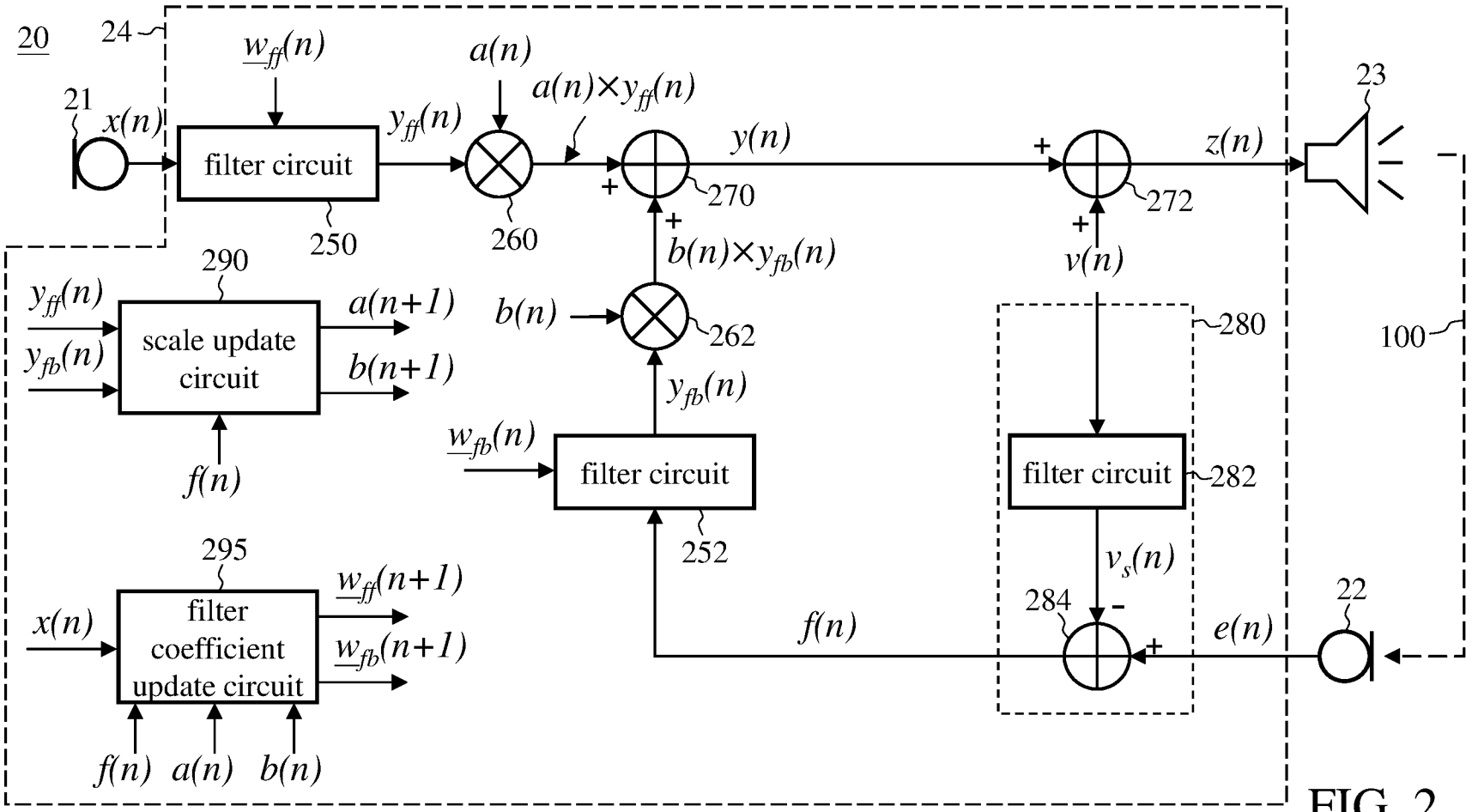
FIG. 2 illustrates a functional block diagram of the sound input and output system according to an embodiment of the present invention.

FIG. 2 is a functional block diagram of the sound input and output system according to an embodiment of the present invention. The sound input and output system 20 includes a sound input device 21, a sound input device 22, a sound output device 23, and a noise cancellation circuit 24. In some embodiments, the sound input and output system 20 may be a headset, the sound input device 21 and the sound input device 22 may be sound capture devices (e.g., each includes at least one microphone), and the sound output device 23 is a sound playback device or a sound generating device (which, for example, includes at least one driver of an earphone or at least one speaker).

The noise cancellation circuit 24 includes a filter circuit 250, a filter circuit 252, a multiplication circuit 260, a multiplication circuit 262, an adder circuit 270, an adder circuit 272, a signal processing circuit 280, a scale update circuit 290, and a filter coefficient update circuit 295.

The sound input device 21 receives the first environmental noise and generates the first input signal x(n). The sound input device 22 receives a sound and generates a second input signal e(n). The sound includes the second environmental noise and the sound outputted by the sound output device 23. The sound output device 23 is used to output the output signal z(n) that the noise cancellation circuit 24 generates. The sound outputted by the sound output device 23 travels to the sound input device 22 via the sound propagation path 100.

The filter circuit 250, coupled to the sound input device 21, filters the first input signal x(n) according to the filter coefficient $\underline{w}_{ff}(n)$ to generate the filtered signal $y_{ff}(n)$. The signal processing circuit 280, coupled to the sound input device 22, generates the feedback signal f(n) according to the second input signal e(n) and the audio signal v(n). The filter circuit 252, coupled to the signal processing circuit 280, filters the feedback signal f(n) according to the filter coefficient $\underline{w}_{fb}(n)$ to generate the filtered signal $y_{fb}(n)$. The multiplication circuit 260, coupled to the filter circuit 250, multiplies the filtered signal $y_{ff}(n)$ by the scale a(n) to generate an intermediate signal $a(n)\times y_{ff}(n)$. The multiplication circuit 262, coupled to the filter circuit 252, multiplies the filtered signal $y_{f\ b}(n)$ by the scale b(n) to generate an intermediate signal $b(n)\times y_{fb}(n)$. The adder circuit 270, coupled to the multiplication circuit 260 and the multiplication circuit 262, adds the intermediate signal $a(n)\times y_{ff}(n)$ to the intermediate signal $b(n)\times y_{fb}(n)$ to generate the noise cancellation signal y(n). The adder circuit 272, coupled to the adder circuit 270, adds the noise cancellation signal y(n) to the audio signal v(n) to generate the output signal z(n).

The signal processing circuit 280 includes a filter circuit 282 and an adder circuit 284. The filter coefficient of the filter circuit 282 can describe the sound propagation path 100, that is, the filter circuit 282 is a model that simulates the sound propagation path 100. The filter circuit 282 filters the audio signal v(n) to generate a filtered signal $v_s(n)$ (i.e., $v_s(n)=v(n)*\underline{\hat{s}}$). The adder circuit 284, coupled to the filter circuit 282, subtracts the filtered signal $v_s(n)$ from the second input signal e(n) to generate the feedback signal f(n). In other words, $f(n)=e(n)-v_s(n)$.

The scale update circuit 290, coupled to the filter circuit 250, the filter circuit 252, the signal processing circuit 280, the multiplication circuit 260, and the multiplication circuit 262, updates the scale a(n) and the scale b(n) according to the filtered signal $y_{ff}(n)$, the filtered signal $y_{f\ b}(n)$, and the feedback signal f(n).

The filter coefficient update circuit 295, coupled to the signal processing circuit 280, the filter circuit 250, and the filter circuit 252, updates the filter coefficient $\underline{w}_{ff}(n)$ and filter coefficient $\underline{w}_{fb}(n)$ according to the first input signal x(n), the feedback signal f(n), the scale a(n), and the scale b(n).

Figure 3:
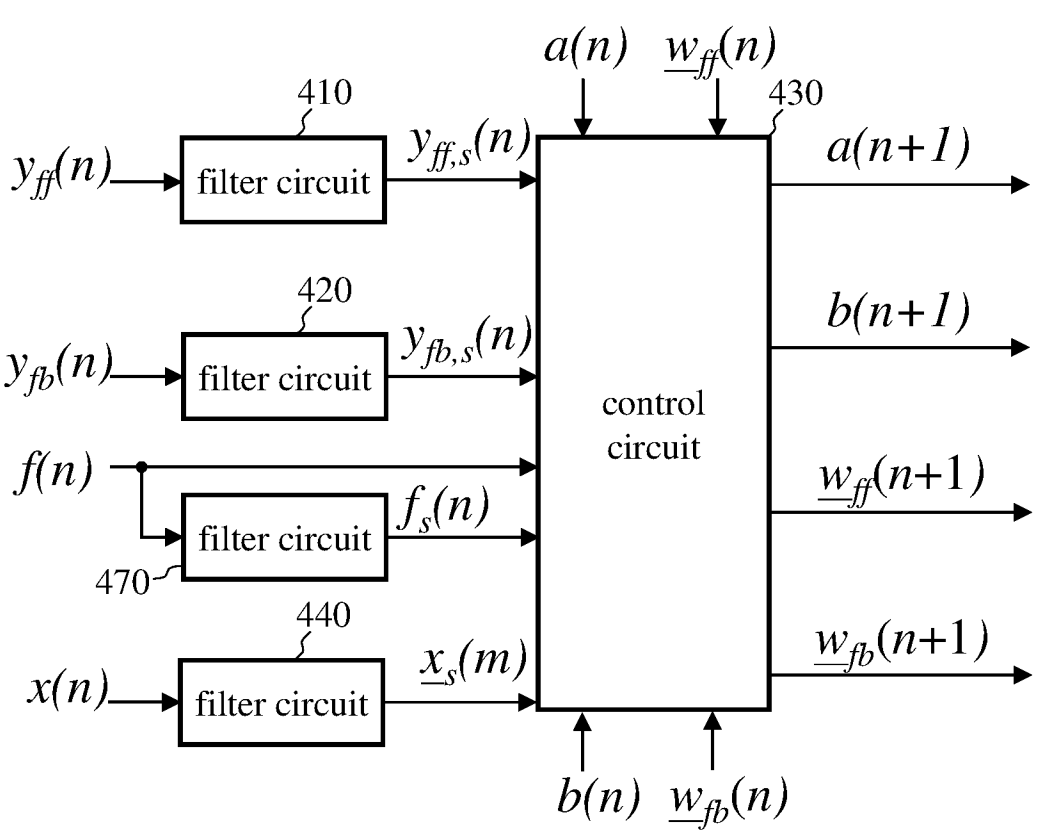
FIG. 3 illustrates a functional block diagram of a scale and filter coefficient update circuit according to an embodiment.

FIG. 3 shows a functional block diagram of the scale and filter coefficient update circuit. The scale and filter coefficient update circuit 300 is an equivalent of the combination of the scale update circuit 290 and the filter coefficient update circuit 295. The scale and filter coefficient update circuit 300 includes a filter circuit 410, a filter circuit 420, a control circuit 430, a filter circuit 440, and a filter circuit 470. The filter circuit 410, the filter circuit 420, and the control circuit 430 are included in the scale update circuit 290, and the control circuit 430, the filter circuit 440, and the filter circuit 470 are included in the filter coefficient update circuit 295. In other words, the scale update circuit 290 and the filter coefficient update circuit 295 share the control circuit 430. The filter coefficients of the filter circuit 410, the filter circuit 420, the filter circuit 440, and the filter circuit 470 can describe the sound propagation path 100, that is, the filter circuit 410, the filter circuit 420, the filter circuit 440, and the filter circuit 470 are each a model that simulates the sound propagation path 100.

The filter circuit 410 filters the filtered signal $y_{ff}(n)$ to generate the filtered signal $y_{ff,s}(n)$ (i.e., $y_{ff,s}(n)=y_{ff}(n)*\underline{\hat{s}}$). The filter circuit 420 filters the filtered signal $y_{fb}(n)$ to generate the filtered signal $y_{fb,s}(n)$ (i.e., $y_{fb,s}(n)=y_{fb}(n)*\underline{\hat{s}}$). The filter circuit 440 filters the first input signal x(n) to generate a filtered signal $\underline{x}_s(n)$ (i.e., $\underline{x}_s(n)=x(n)*\underline{\hat{s}}$). The filter circuit 470 filters the feedback signal f(n) to generate a filtered signal $f_s(n)$ (i.e., $f_s(n)=f(n)*\underline{\hat{s}}$).

In some embodiments, the control circuit 430 uses the steepest descent algorithm to update the scale a(n) and the scale b(n). For example, the control circuit 430 updates the scale a(n) and the scale b(n) according to equation (3).

$$\begin{cases} a(n+1) = a(n) - \frac{1}{2}\mu_a \times \frac{\partial J}{\partial a} \\ b(n+1) = b(n) - \frac{1}{2}\mu_b \times \frac{\partial J}{\partial b} \end{cases} \tag{3}$$

$\mu_a$ and $\mu_b$ are the step sizes used in the update, and J is the cost function. When the cost function is to minimize the power of the feedback signal f(n), the equation (3) becomes:

$$\begin{cases} a(n+1) = a(n) - \mu_a \times y_{ff,s}(n) \times f(n) \\ b(n+1) = b(n) - \mu_b \times y_{fb,s}(n) \times f(n) \end{cases} \tag{4}$$

In other words, as shown in equation (4), the control circuit 430 updates the scale a(n) and the scale b(n) according to the filtered signal $y_{ff,s}(n)$, the filtered signal $y_{fb,s}(n)$, and the feedback signal f(n). In some embodiments, the stability of the system can be increased (i.e., the convergence of the scale a(n+1) and the scale b(n+1) becomes more stable) by limiting the upper bound and lower bound of the feedback signal f(n). For more details about limiting the upper and lower bounds of f(n), please refer to: Ted S. Wada and Biing-Hwang Juang, "Enhancement of Residual Echo for Robust Acoustic Echo Cancellation," IEEE Transactions on Audio, Speech, and Language Processing, Vol. 20, No. 1, January 2012.

The control circuit 430 updates the filter coefficient $\underline{w}_{ff}(n)$ and the filter coefficient $\underline{w}_{fb}(n)$ according to equation (5).

$$\begin{cases} \underline{w}_{ff}(n+1) = \underline{w}_{ff}(n) - a(n) \times \mu_{ff} \times \underline{x}_s(n) \times f(n) \\ \underline{w}_{fb}(n+1) = \underline{w}_{fb}(n) - b(n) \times \mu_{fb} \times \underline{f}_s(n) \times f(n) \end{cases} \tag{5}$$

$\underline{x}_s(n)$ is a vector having the same length as $\underline{w}_{ff}$. If the length of $\underline{w}_{ff}$ is L, which is a positive integer, then $\underline{x}_s(n)=[x_s(n), x_s(n-1), \ldots, x_s(n-L+1)]^T$. $\mu_{ff}$ and $\mu_{fb}$ are the step sizes used in the update. In other words, as shown in equation (5), the control circuit 430 updates the filter coefficient $\underline{w}_{ff}(n)$ and filter coefficient $\underline{w}_{fb}(n)$ according to the filtered signal $\underline{x}_s(n)$, the feedback signal f(n), the scale a(n), and the scale b(n).

Figure 4:
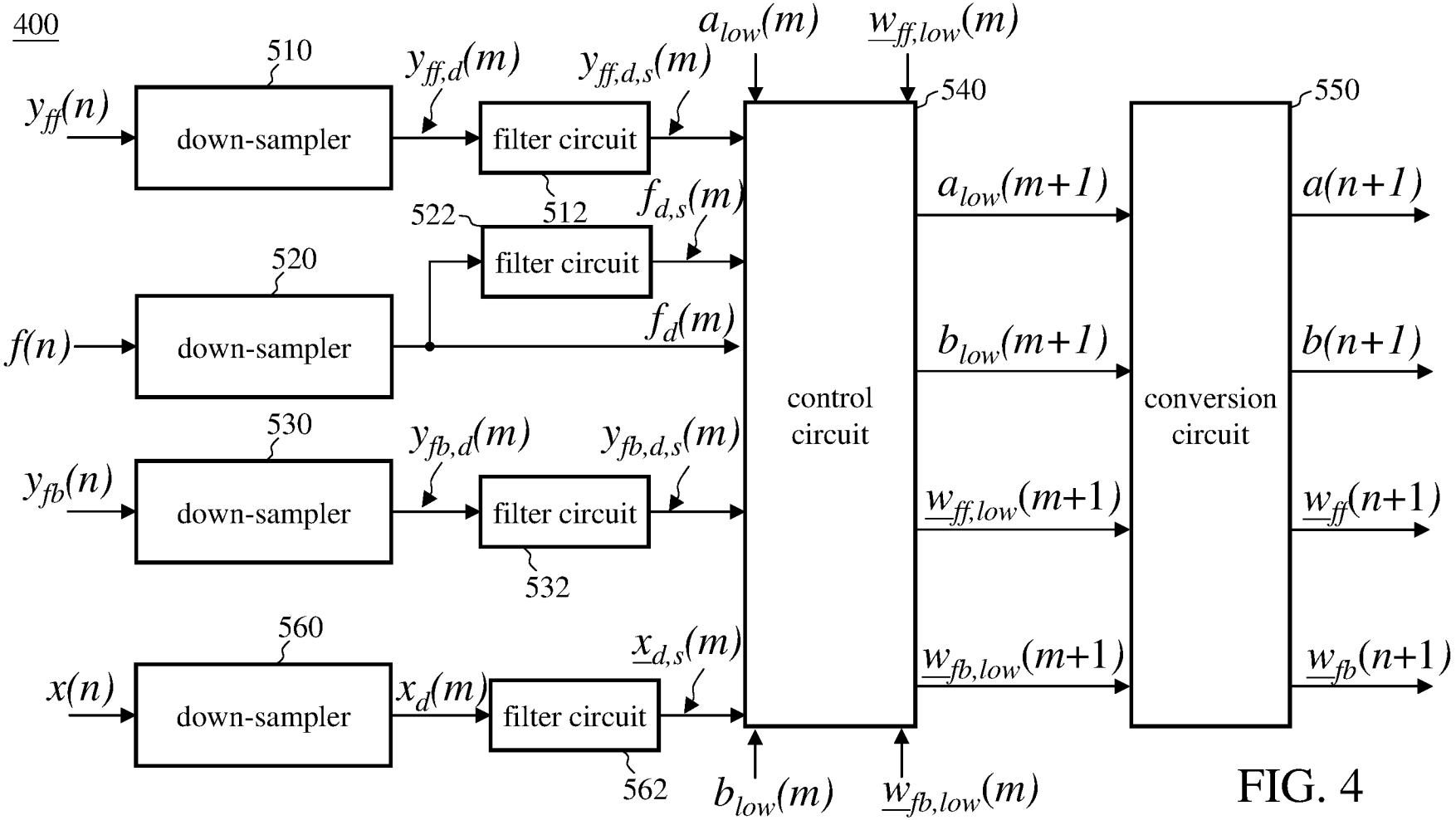
FIG. 4 illustrates a functional block diagram of a scale and filter coefficient update circuit according to another embodiment.

FIG. 4 shows a functional block diagram of a scale and filter coefficient update circuit according to another embodiment. The scale and filter coefficient update circuit 400 is an equivalent of the combination of the scale update circuit 290 and the filter coefficient update circuit 295. The scale update circuit 290 includes a down-sampler 510, a filter circuit 512, a down-sampler 520, a filter circuit 522, a down-sampler 530, a filter circuit 532, a control circuit 540, and a conversion circuit 550, a down-sampler 560, and a filter circuit 562. The down-sampler 510, the filter circuit 512, the down-sampler 520, the down-sampler 530, the filter circuit 532, the control circuit 540, and the conversion circuit 550 are included in the scale update circuit 290, and the down-sampler 520, the filter circuit 522, the control circuit 540, the conversion circuit 550, the down-sampler 560, and the filter circuit 562 are included in the filter coefficient update circuit 295. In other words, the scale update circuit 290 and the filter coefficient update circuit 295 share the down-sampler 520, the control circuit 540, and the conversion circuit 550. The filter circuit 512, the filter circuit 522, the filter circuit 532, and the filter circuit 562 are each a model of the sound propagation path 100 at a low sampling frequency (the filter coefficient is represented by $\underline{\hat{s}}_{low}$).

The down-sampler 510 down-samples the filtered signal $y_{ff}(n)$ to generate the down-sampled signal $y_{ff,d}(m)$. The filter circuit 512, coupled to the down-sampler 510, filters the down-sampled signal $y_{ff,d}(m)$ to generate a filtered signal $y_{ff,d,s}(m)$ (i.e., $y_{ff,d,s}(m)=y_{ff,d}(m)*\underline{\hat{s}}_{low}$). The down-sampler 520 down-samples the feedback signal f(n) to generate the down-sampled signal $f_d(m)$. The filter circuit 522, coupled to the down-sampler 520, filters the down-sampled signal $f_d(m)$ to generate a filtered signal $f_{d,s}(m)$ (i.e., $f_{d,s}(m)=(m)*\underline{\hat{s}}_{low}$). The down-sampler 530 down-samples the filtered signal $y_{fb}(n)$ to generate the down-sampled signal $y_{fb,d}(m)$. The filter circuit 532, coupled to the down-sampler 530, filters the down-sampled signal $y_{fb,d}(m)$ to generate the filtered signal $y_{fb,d,s}(m)$ (i.e., $y_{fb,d,s}(m)=y_{fb,d}(m)*\underline{\hat{s}}_{low}$). The down-sampler 560 down-samples the first input signal x(n) to generate the down-sampled signal $x_d(m)$. The filter circuit 562, coupled to the down-sampler 560, filters the down-sampled signal $x_d(m)$ to generate a filtered signal $\underline{x}_{d,s}(m)$ (i.e., $\underline{x}_{d,s}(m)=x_d(m)*\underline{\hat{s}}_{low}$).

The control circuit 540, coupled to the filter circuit 512, the down-sampler 520, the filter circuit 522, the filter circuit 532, and the filter circuit 562, generates the down-sampled scale $a_{low}(m+1)$ and the down-sampled scale $b_{low}(m+1)$ according to equation (6), and generates the down-sampled filter coefficient $\underline{w}_{ff,low}(m+1)$ and the down-sampled filter coefficient $\underline{w}_{fb,low}(m+1)$ according to equation (7). Note that $\mu_a$ and $\mu_b$ in equation (6) can be different from $\mu_a$ and $\mu_b$ in equation (4), respectively.

$$\begin{cases} a_{low}(m+1) = a_{low}(m) - \mu_a \times y_{ff,d,s}(m) \times f_d(m) \\ b_{low}(m+1) = b_{low}(m) - \mu_b \times y_{fb,d,s}(m) \times f_d(m) \end{cases} \tag{6}$$

$$\begin{cases} \underline{w}_{ff,low}(m+1) = \underline{w}_{ff,low}(m) - a_{low}(m) \times \mu_{ff} \times \underline{x}_{d,s}(m) \times f_d(m) \\ \underline{w}_{fb,low}(m+1) = \underline{w}_{fb,low}(m) - b_{low}(m) \times \mu_{fb} \times \underline{f}_{d,s}(m) \times f_d(m) \end{cases} \tag{7}$$

In other words, the control circuit 540 generates the down-sampled scale $a_{low}(m+1)$ and down-sampled scale $b_{low}(m+1)$ according to the filtered signal $y_{ff,d,s}(m)$, the filtered signal $y_{fb,d,s}(m)$ and the down-sampled signal $f_d(m)$ (as shown in equation (6)), and generates the down-sampled filter coefficient $\underline{w}_{ff,low}(m+1)$ and down-sampled filter coefficient $\underline{w}_{fb,low}(m+1)$ according to the filtered signal $\underline{x}_{d,s}(m)$, the down-sampled signal $f_d(m)$, the down-sampled scale $a_{low}(m)$ and the down-sampled scale $b_{low}(m)$ (as shown in equation (7)).

The conversion circuit 550, coupled to the control circuit 540, converts the down-sampled scale $a_{low}(m+1)$ and the down-sampled scale $b_{low}(m+1)$ into a scale a(n+1) and scale b(n+1) (which is equivalent to updating the scale a(n) and scale b(n)), and the down-sampled filter coefficient $\underline{w}_{ff,low}(m+1)$ and the down-sampled filter coefficient $\underline{w}_{fb,low}(m+1)$ into the filter coefficient $\underline{w}_{ff}(n+1)$ and the filter coefficient $\underline{w}_{fb}(n+1)$ (which is equivalent to updating the filter coefficient $\underline{w}_{ff}(n)$ and filter coefficient $\underline{w}_{fb}(n)$). For example, the conversion circuit 550 can perform conversion according to the following equation.

$$\begin{cases} a(n) = a_{low}(m), \text{ when } n = m \times T_{low} / T_{high} \\ a(n) = a(n-1), \text{ others} \end{cases} \tag{8}$$

where $T_{low}$ and $T_{high}$ are the sampling periods of the low sample rate and the high sample rate, respectively.

In some embodiments, the conversion circuit 550 performs conversion by means of up-sampling. In other embodiments, the conversion circuit 550 performs conversion by means of frequency stacking (more details can be found in the paper: Dennis R. Morgan and James C. Thi, "A Delayless Subband Adaptive Filter Architecture," IEEE Transactions on Signal Processing, Vol. 43, No. 8, August 1995).

Figure 5:
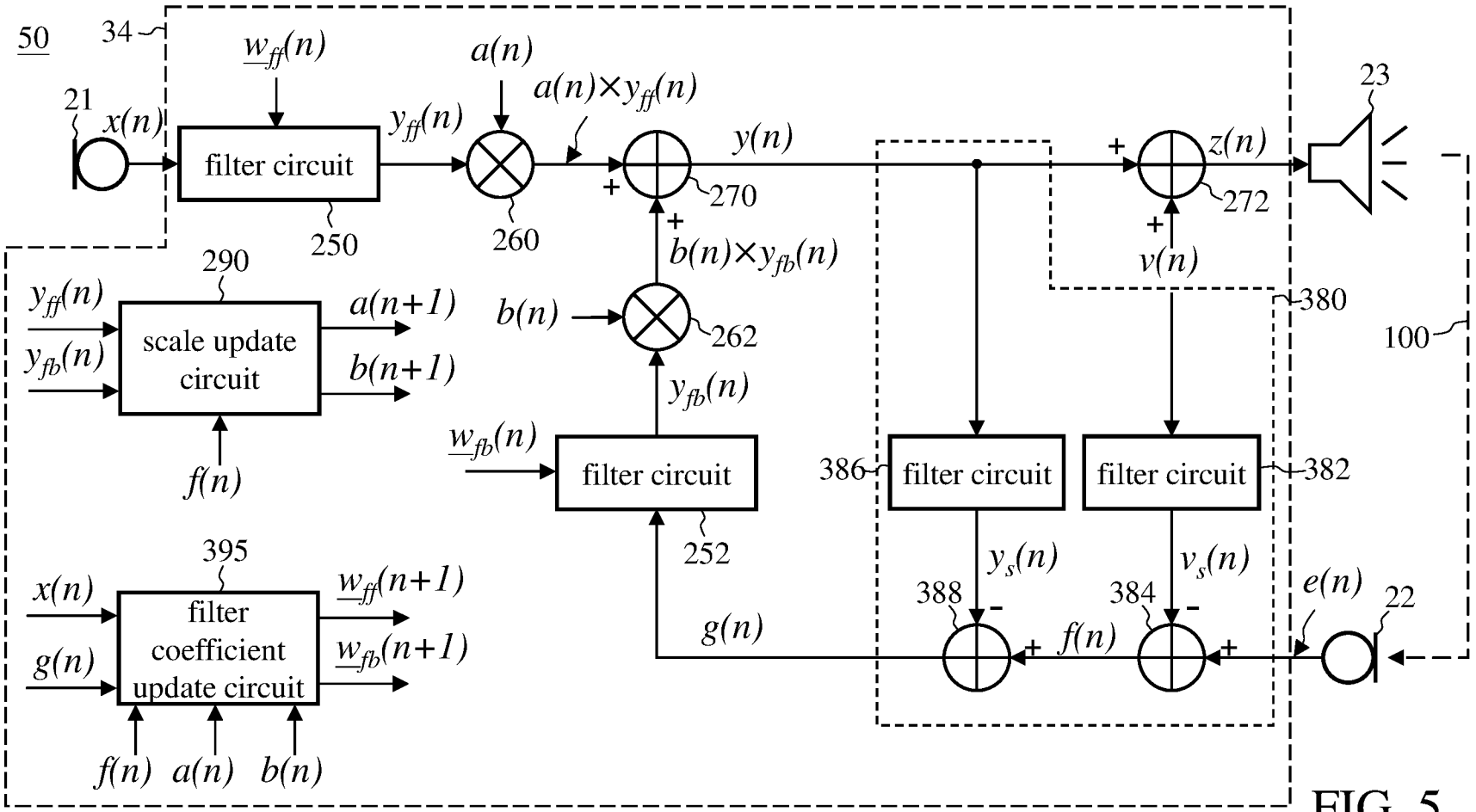
FIG. 5 illustrates a functional block diagram of the sound input and output system according to another embodiment of the present invention.

FIG. 5 is a functional block diagram of the sound input and output system according to another embodiment of the present invention. The sound input and output system 50 is similar to the sound input and output system 20, except that the noise cancellation circuit 34 includes a signal processing circuit 380 (instead of the signal processing circuit 280) and a filter coefficient update circuit 395 (instead of the filter coefficient update circuit 295).

The signal processing circuit 380 includes a filter circuit 382, an adder circuit 384, a filter circuit 386, and an adder circuit 388. The functions of the filter circuit 382 and the adder circuit 384 are the same as those of the filter circuit 282 and the adder circuit 284, respectively, so the details are thus omitted for brevity. The filter coefficient of the filter circuit 386 can describe the sound propagation path 100, that is, the filter circuit 386 is a model that simulates the sound propagation path 100. The filter circuit 386 filters the noise cancellation signal y(n) to generate a filtered signal $y_s(n)$ (i.e., $y_s(n)=y(n)*\underline{\hat{s}}$). The adder circuit 388, coupled to the filter circuit 252, the adder circuit 384, and the filter circuit 386, subtracts the filtered signal $y_s(n)$ from the intermediate signal f(n) to generate the feedback signal g(n). In other words, $g(n)=f(n)-y_s(n)$. The intermediate signal f(n) in FIG. 5 and the feedback signal f(n) in FIG. 2 are same signal. The filter circuit 252 filters the feedback signal g(n) to generate the filtered signal $y_{fb}(n)$.

Figure 6:
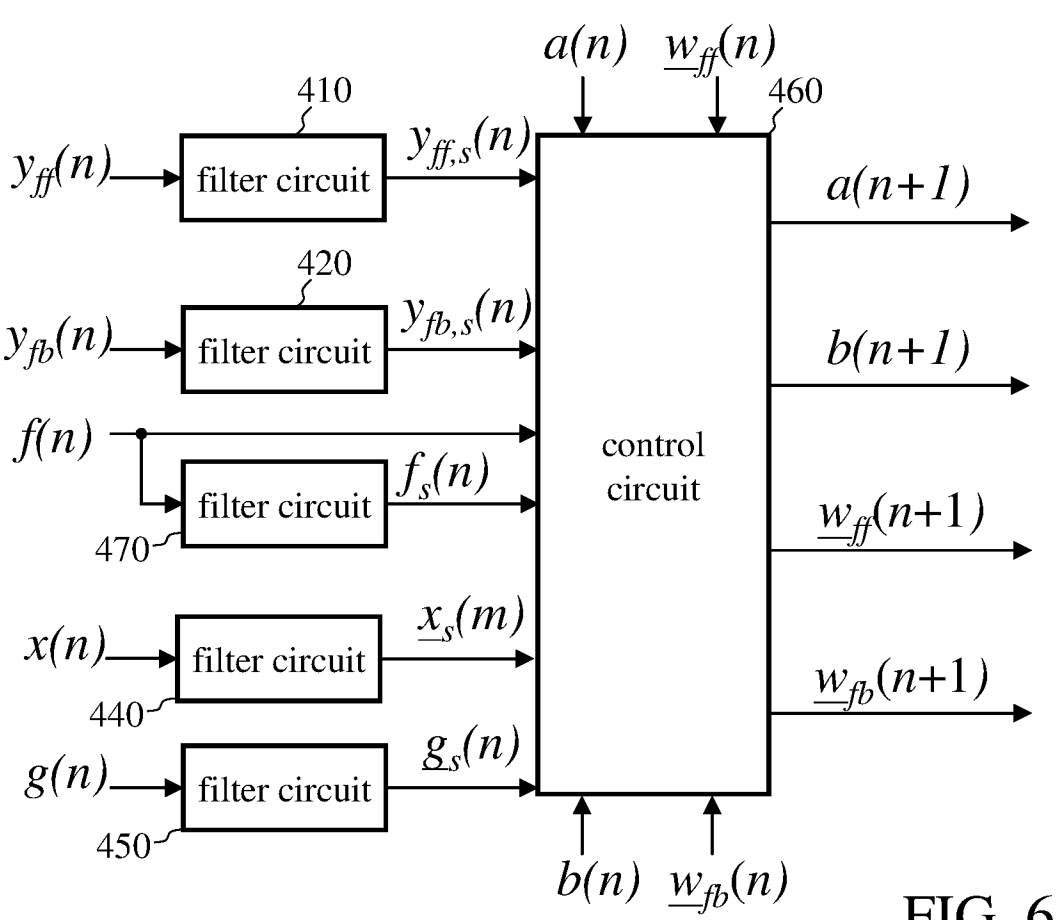
FIG. 6 illustrates a functional block diagram of a scale and filter coefficient update circuit according to another embodiment.

FIG. 6 shows a functional block diagram of a scale and filter coefficient update circuit according to another embodiment. The scale and filter coefficient update circuit 600 is an equivalent of the combination of the scale update circuit 290 and the filter coefficient update circuit 395. The scale and filter coefficient update circuit 600 includes a filter circuit 410, a filter circuit 420, a filter circuit 440, a filter circuit 450, a control circuit 460, and a filter circuit 470. The filter circuit 410, the filter circuit 420, and the control circuit 460 are included in the scale update circuit 290, and the filter circuit 440, the filter circuit 450, the control circuit 460, and the filter circuit 470 are included in the filter coefficient update circuit 395. In other words, the scale update circuit 290 and the filter coefficient update circuit 395 share the control circuit 460. The filter coefficient of the filter circuit 450 can describe the sound propagation path 100, that is, the filter circuit 450 is a model that simulates the sound propagation path 100. The filter circuit 450 filters the feedback signal g(n) to generate the filtered signal $g_s(n)$ (i.e., $g_s(n)=g(n)*\underline{\hat{s}}$). The control circuit 460 is coupled to the filter circuit 410, the filter circuit 420, the filter circuit 440, the filter circuit 450, and the filter circuit 470.

The control circuit 460 updates the scale a(n) and the scale b(n) according to equation (4), and updates the filter coefficient $\underline{w}_{ff}(n)$ and the filter coefficient $\underline{w}_{fb}(n)$ according to the following equation.

$$\begin{cases} \underline{w}_{ff}(n+1) = \underline{w}_{ff}(n) - a(n) \times \mu_{ff} \times \underline{x}_s(n) \times f(n) \\ \underline{w}_{fb}(n+1) = \underline{w}_{fb}(n) - b(n) \times \mu_{fb} \times \underline{g}_s(n) \times f(n) \end{cases} \tag{9}$$

In other words, as shown in equation (9), the control circuit 460 updates the filter coefficient $\underline{w}_{ff}(n)$ and the filter coefficient $\underline{w}_{bb}(n)$ according to the filtered signal $\underline{x}_s(n)$, the feedback signal f(n), the filtered signal $g_s(n)$, the scale a(n) and the scale b(n).

Figure 7:
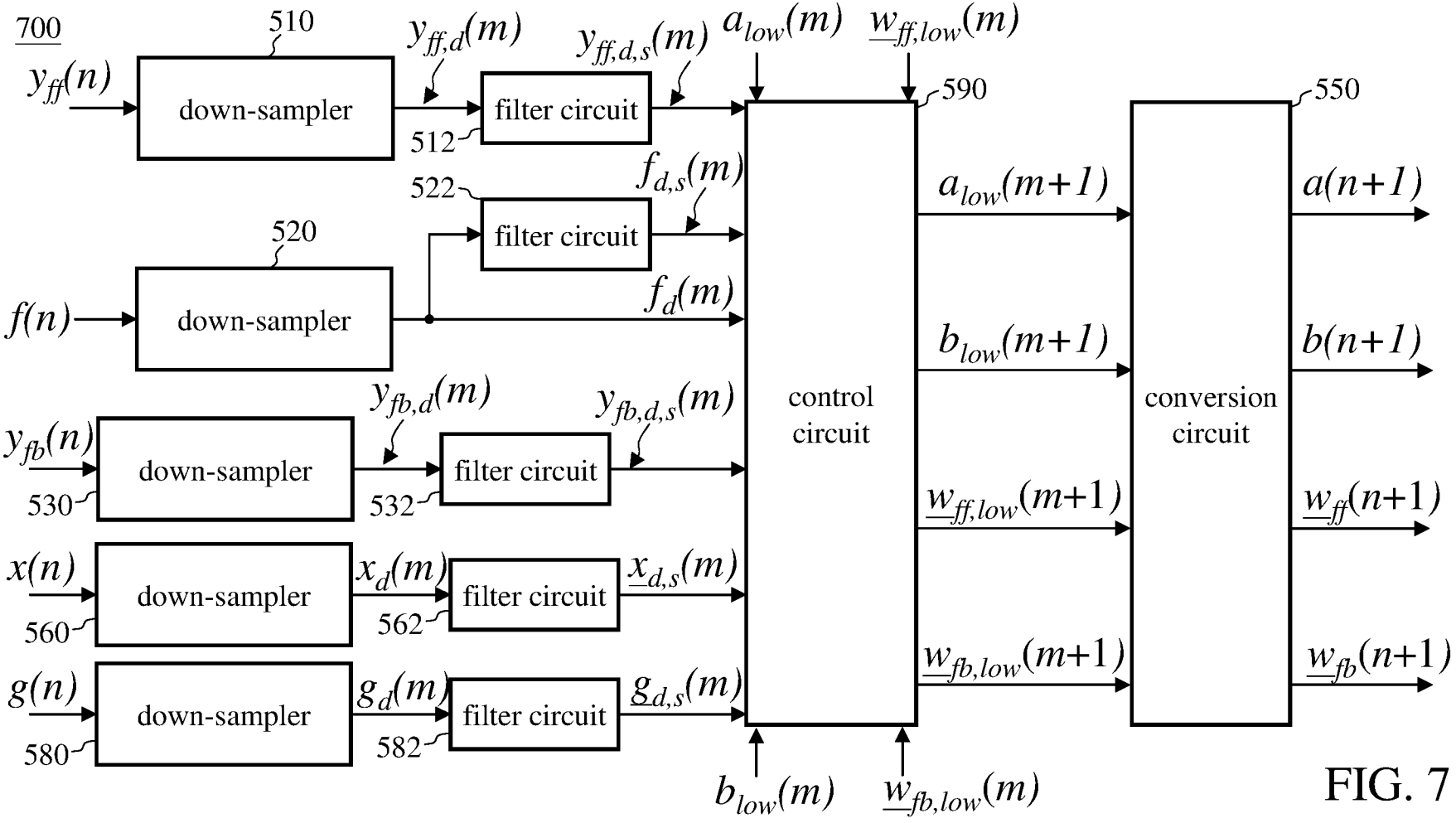
FIG. 7 illustrates a functional block diagram of a scale and filter coefficient update circuit according to another embodiment.

FIG. 7 shows a functional block diagram of a scale and filter coefficient update circuit according to another embodiment. The scale and filter coefficient update circuit 700 is an equivalent of the combination of the scale update circuit 290 and the filter coefficient update circuit 395. The scale and filter coefficient update circuit 700 includes a down-sampler 510, a filter circuit 512, a down-sampler 520, a filter circuit 522, a down-sampler 530, a filter circuit 532, a down-sampler 560, and a filter circuit 562, a down-sampler 580, a filter circuit 582, a control circuit 590, and the conversion circuit 550. The down-sampler 510, the filter circuit 512, the down-sampler 520, the down-sampler 530, the filter circuit 532, the control circuit 590, and the conversion circuit 550 are included in the scale update circuit 290, and the down-sampler 520, the filter circuit 522, the down-sampler 560, the filter circuit 562, the down-sampler 580, the filter circuit 582, the control circuit 590, and the conversion circuit 550 are included in filter coefficient update circuit 395. In other words, the scale update circuit 290 and the filter coefficient update circuit 395 share the down-sampler 520, the control circuit 590, and the conversion circuit 550. The down-sampler 580 down-samples the feedback signal g(n) to generate the down-sampled signal $g_d(m)$. The filter circuit 582 is a model of the sound propagation path 100 at a low sampling frequency. The filter circuit 582, coupled to the down-sampler 580, filters the down-sampled signal $g_d(m)$ to generate a filtered signal $g_{d,s}(m)$ (i.e., $\underline{g}_{d,s}(m)=g_d(m)*\underline{\hat{s}}_{low}$).

The control circuit 590 generates the down-sampled scale $a_{low}(m+1)$ and the down-sampled scale $b_{low}(m+1)$ according to equation (6), and generates the down-sampled filter coefficient $\underline{w}_{ff,low}(m+1)$ and the down-sampled filter coefficient $\underline{w}_{fb,low}(m+1)$ according to the following equation.

$$\begin{cases} \underline{w}_{ff,low}(m+1) = \underline{w}_{ff,low}(m) - a_{low}(m) \times \mu_{ff} \times \underline{x}_{d,s}(m) \times f_d(m) \\ \underline{w}_{fb,low}(m+1) = \underline{w}_{fb,low}(m) - b_{low}(m) \times \mu_{fb} \times \underline{g}_{d,s}(m) \times f_d(m) \end{cases} \tag{10}$$

In other words, as shown in equation (10), the control circuit 590 generates the down-sampled filter coefficient $\underline{w}_{ff,low}(m+1)$ and the down-sampled filter coefficient $\underline{w}_{fb,low}(m+1)$ according to the filtered signal $\underline{x}_{d,s}(m)$, the down-sampled signal $f_d(m)$, the filtered signal $\underline{g}_{d,s}(m)$, the down-sampled scale $a_{low}(m)$, and the down-sampled scale $b_{low}(m)$.

The above-mentioned scale a(n), scale b(n), filter coefficient $\underline{w}_{ff}(n)$, filter coefficient $\underline{w}_{fb}(n)$, down-sampled scale $a_{low}(m)$, down-sampled scale $b_{low}(m)$, down-sampled filter coefficient $\underline{w}_{ff,low}(m)$ and down-sampled filter coefficient $\underline{w}_{fb,low}(m)$ can be stored in the memory (not shown). The control circuits 430, 540, 460, and 590 can be circuits or electronic components with program execution capabilities, such as central processing units, microprocessors, microprocessing units, digital signal processors (DSPs) or their equivalent circuits. The control circuits 430, 540, 460, and 590 perform the above calculations by executing program codes or program instructions stored in the memory. The control circuits 430, 540, 460, and 590 may or may not include the memory.

In other embodiments, people having ordinary skill in the art can design the control circuits 430, 540, 460, and 590 based on the above discussions. That is, the control circuits 430, 540, 460, and 590 can be application specific integrated circuits (ASICs) or embodied by circuits or hardware such as programmable logic devices (PLDs).

People having ordinary skill in the art can embody the conversion circuit 550 by hardware (e.g., a circuit composed of transistors) or soft/firmware according to the above discussions. When the conversion circuit 550 is embodied by software/firmware, the conversion circuit 550 can be integrated into the control circuit 540 or the control circuit 590; that is, the control circuit 540 or the control circuit 590 executes the program code or program instructions to perform the conversion.

Figure 8:
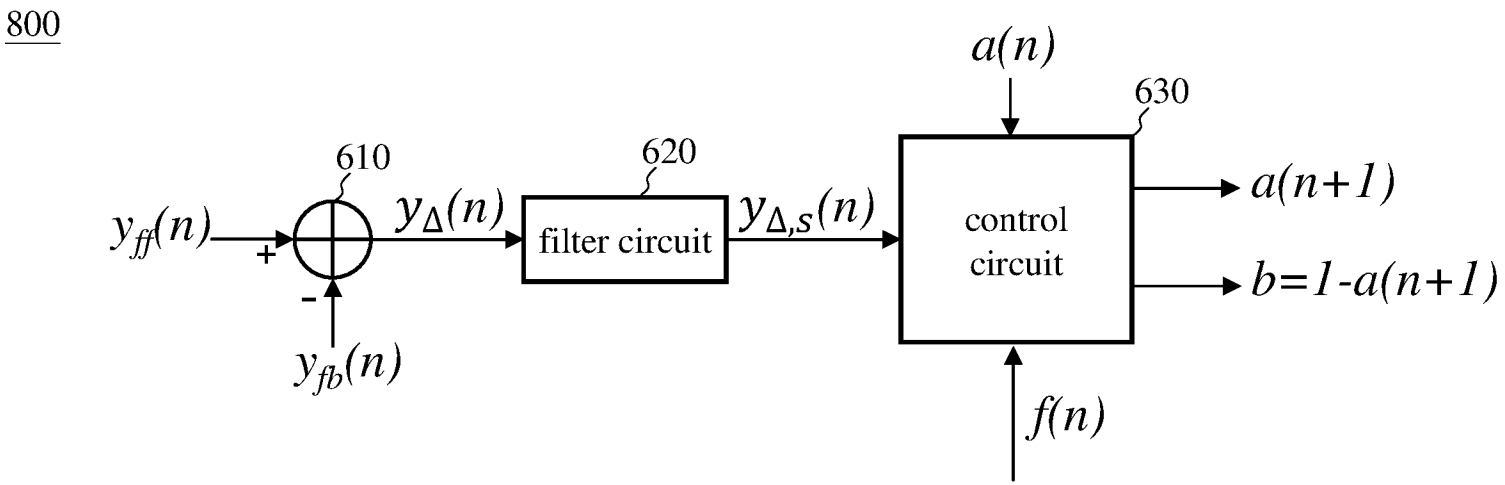
FIG. 8 illustrates a functional block diagram of a scale update circuit according to an embodiment.

In some embodiments, in order to simplify the circuit and/or reduce the burden of the control circuit 430, the control circuit 540, the control circuit 460, and the control circuit 590, the scale a(n) and the scale b(n) can be designed to by a certain rule, such as a(n)+b(n)=c, where c is an integer. For example, the scale update circuit 800 of FIG. 8 is an embodiment of the scale update circuit 290 (corresponding to b(n)=1−a(n)). The scale update circuit 800 includes an adder circuit 610, a filter circuit 620, and a control circuit 630. The adder circuit 610, coupled to the filter circuit 250 and the filter circuit 252, subtracts the filtered signal $y_{fb}(n)$ from the filtered signal $y_{ff}(n)$ to generate a difference signal $y_{\Delta}(n)$. The filter coefficient of the filter circuit 620 can describe the sound propagation path 100, that is, the filter circuit 620 is a model that simulates the sound propagation path 100. The filter circuit 620, coupled to the adder circuit 610, filters the difference signal $y_{\Delta}(n)$ to generate the filtered signal $y_{\Delta,s}(n)$ (i.e., $y_{\Delta,s}(n)=y_{\Delta}(n)*\underline{\hat{s}}$). The control circuit 630, coupled to the filter circuit 620, updates the scale a(n) according to the following equation.

$$a(n+1)=a(n)-\mu_a\times y_{\Delta,s}(n)\times f(n) \tag{11}$$

In other words, the control circuit 630 updates the scale a(n) according to the filtered signal $y_{\Delta,s}(n)$ and the feedback signal f(n). Because b(n+1)=1−a(n+1), updating the scale a(n) means the scale b(n) is also updated at the same time.

Figure 9:
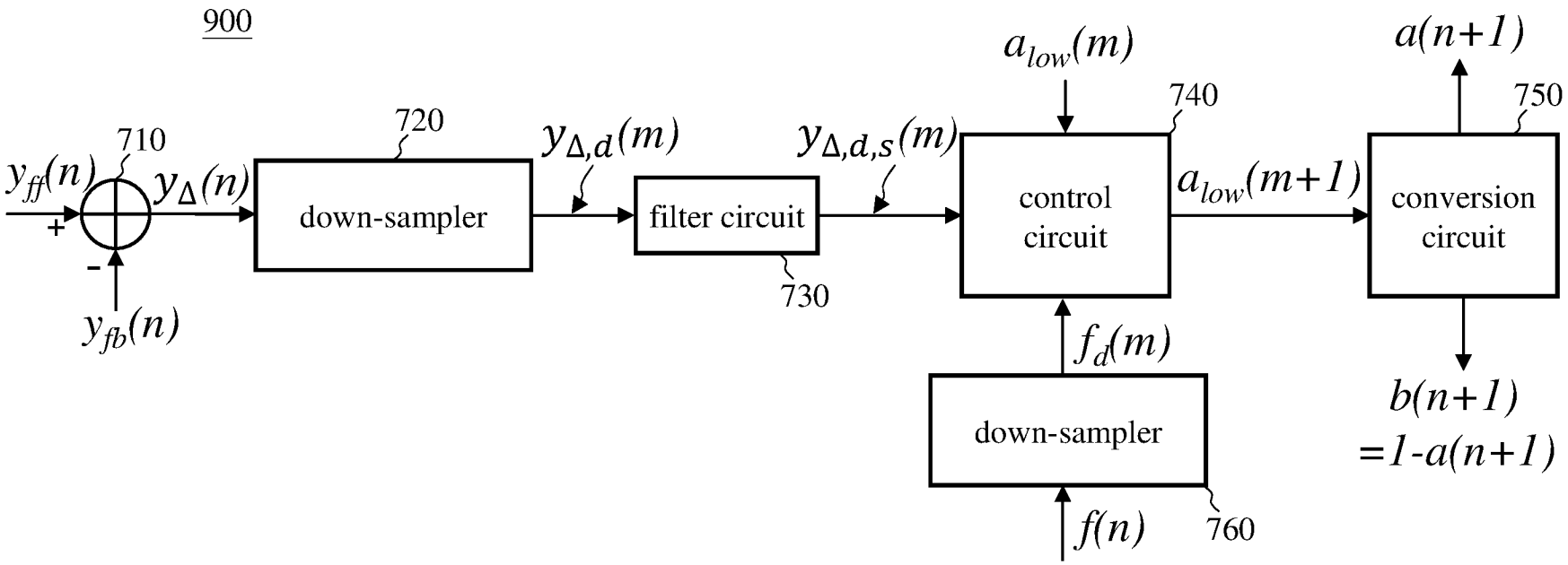
FIG. 9 illustrates a functional block diagram of a scale update circuit according to another embodiment.

The scale update circuit 900 in FIG. 9 is another embodiment of the scale update circuit 290 (also corresponding to b(n)=1−a(n)), which helps to reduce the burden of the control circuit. The scale update circuit 900 includes an adder circuit 710, a down-sampler 720, a filter circuit 730, a control circuit 740, a conversion circuit 750, and a down-sampler 760.

The function of the adder circuit 710 is the same as that of the adder circuit 610, so the details are thus omitted for brevity. The down-sampler 720, coupled to the adder circuit 710, down-samples the difference signal $y_{\Delta}(n)$ to generate the down-sampled signal $y_{\Delta,d}(m)$. The filter circuit 730 is a model of the sound propagation path 100 at a low sampling frequency. The filter circuit 730, coupled to the down-sampler 720, filters the down-sampled signal $y_{\Delta,d}(m)$ to generate the filtered signal $y_{\Delta,d,s}(m)$ (i.e., $y_{\Delta,d,s}(m)=y_{\Delta,d}(m)*\underline{\hat{s}}_{low}$). The down-sampler 760, coupled to the signal processing circuit 280 or the scale update circuit 290, down-samples the feedback signal f(n) (corresponding to the sound input and output system 20) or the intermediate signal f(n) (corresponding to the sound input and output system 50) to generate the down-sampled signal $f_d(m)$. The control circuit 740, coupled to the filter circuit 730 and the down-sampler 760, generates the down-sampled scale $a_{low}(m+1)$ according to the following equation.

$$a_{low}(m+1)=a_{low}(m)-\mu_a\times y_{\Delta,d,s}(m)\times f_d(m) \tag{12}$$

In other words, the control circuit 740 generates the down-sampled scale $a_{low}(m+1)$ according to the filtered signal $y_{\Delta,d,s}(m)$ and the down-sampled signal $f_d(m)$. The conversion circuit 750, coupled to the control circuit 740, converts the down-sampled scale $a_{low}(m+1)$ into the scale a(n+1).

Figure 10:
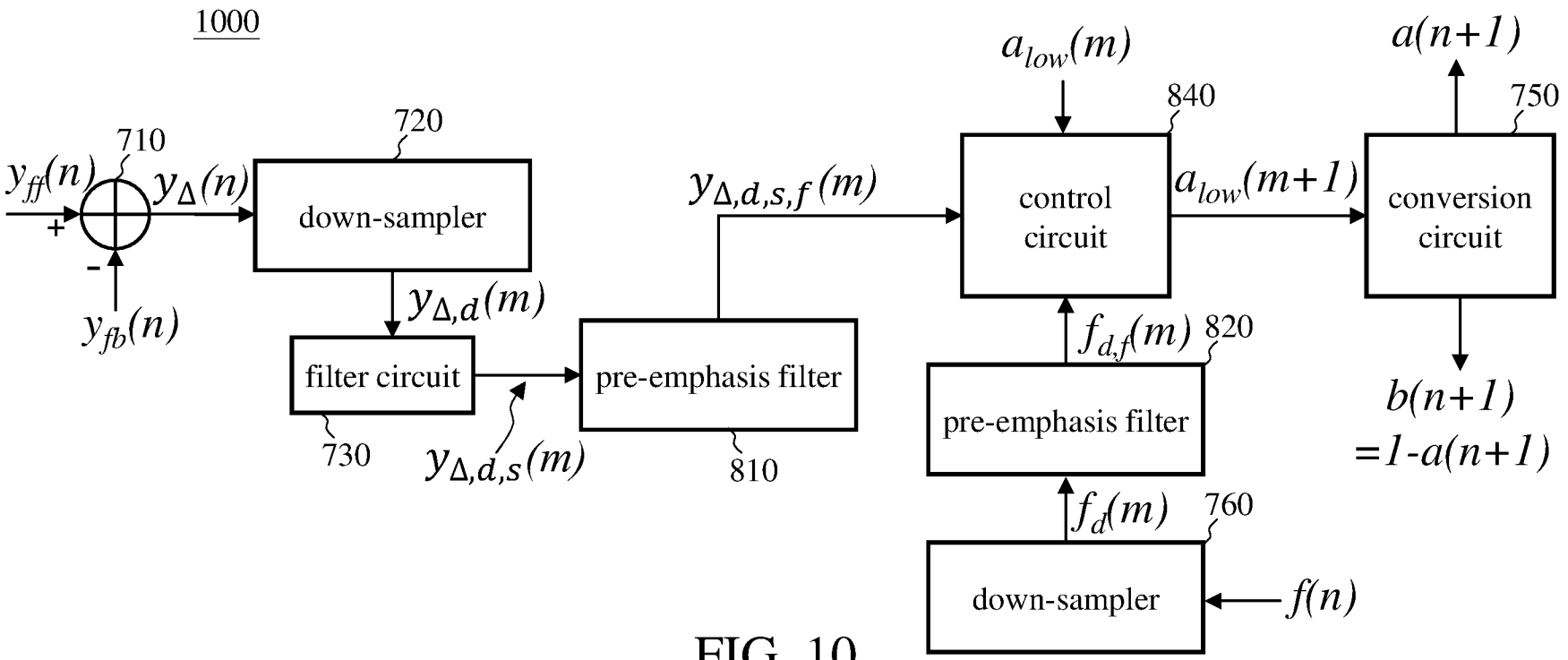
FIG. 10 illustrates a functional block diagram of a scale update circuit according to another embodiment.

In some embodiments, a pre-emphasis filter can be incorporated into the circuits of FIGS. 4 and 7, between, for example, the filter circuit 562 and the control circuit 540 (or the control circuit 590), between the down-sampler 520 and the control circuit 540 (or the control circuit 590), and between the filter circuit 582 and the control circuit 590. The pre-emphasis filter can select the desired frequency band for noise cancellation and improve the effect of noise cancellation. As a result of the incorporation of the pre-emphasis filter, FIG. 10 shows a functional block diagram of the scale update circuit 290 according to another embodiment (also corresponding to b(n)=1−a(n)). In comparison with FIG. 9, the scale update circuit 1000 of FIG. 10 includes a control circuit 840 and further includes a pre-emphasis filter 810 and a pre-emphasis filter 820. The pre-emphasis filter may be a finite impulse response (FIR) filter or an infinite impulse response (IIR) filter.

The pre-emphasis filter 810, coupled between the filter circuit 730 and the control circuit 840, adjusts the filtered signal $y_{\Delta,d,s}(m)$ to the frequency band of interest to generate the adjusted filtered signal $y_{\Delta,d,s,f}(m)$. The pre-emphasis filter 820, coupled between the down-sampler 760 and the control circuit 840, adjusts the down-sampled signal $f_d(m)$ to the frequency band of interest to generate the adjusted down-sampled signal $f_{d,f}(m)$. The control circuit 840 updates the down-sampled scale $a_{low}(m+1)$ according to the following equation.

$$a_{low}(m+1)=a_{low}(m)-\mu_a\times y_{\Delta,d,s,f}(m)\times f_{d,f}(m) \tag{13}$$

In comparison with the prior art, the sound input and output system and noise cancellation circuit of the present invention can increase the convergence speed of the filter coefficients and improve the convergence performance.

Please note that the shape, size, and ratio of any element in the disclosed figures are exemplary for understanding, not for limiting the scope of this invention.

The aforementioned descriptions represent merely the preferred embodiments of the present invention, without any intention to limit the scope of the present invention thereto. Various equivalent changes, alterations, or modifications based on the claims of the present invention are all consequently viewed as being embraced by the scope of the present invention.

What is claimed is:

1. A sound input and output system for processing an audio signal and generating an output signal, comprising:

a sound output device for outputting the output signal;

a first sound input device for generating a first input signal;

a second sound input device for generating a second input signal;

a first filter circuit, coupled to the first sound input device, for filtering the first input signal according to a first filter coefficient to generate a first filtered signal;

a signal processing circuit, coupled to the second sound input device, for generating a feedback signal according to the second input signal and the audio signal, wherein the signal processing circuit filters the audio signal to generate a filtered audio signal, and the feedback signal comprises a calculation result of the filtered audio signal and the second input signal;

a second filter circuit, coupled to the signal processing circuit, for filtering the feedback signal according to a second filter coefficient to generate a second filtered signal;

a first multiplication circuit, coupled to the first filter circuit, for multiplying the first filtered signal by a first scale to generate a first intermediate signal;

a second multiplication circuit, coupled to the second filter circuit, for multiplying the second filtered signal by a second scale to generate a second intermediate signal;

a first adder circuit, coupled to the first multiplication circuit and the second multiplication circuit, for adding the first intermediate signal to the second intermediate signal to generate a noise cancellation signal; and a second adder circuit, coupled to the first adder circuit, for adding the noise cancellation signal to the audio signal to generate the output signal.

2. The sound input and output system of claim 1, wherein the signal processing circuit comprises:

a third filter circuit for filtering the audio signal to generate a third filtered signal; and a third adder circuit, coupled to the third filter circuit, for subtracting the third filtered signal from the second input signal to generate the feedback signal.

3. The sound input and output system of claim 2, further comprising:

a scale update circuit, coupled to the first filter circuit, the second filter circuit, the signal processing circuit, the first multiplication circuit, and the second multiplication circuit, for updating the first scale and the second scale according to the first filtered signal, the second filtered signal, and the feedback signal; and a filter coefficient update circuit, coupled to the signal processing circuit, the first filter circuit, and the second filter circuit, for updating the first filter coefficient and the second filter coefficient according to the first input signal, the feedback signal, the first scale, and the second scale.

4. The sound input and output system of claim 2, further comprising:

a fourth filter circuit for filtering the first filtered signal to generate a fourth filtered signal;

a fifth filter circuit for filtering the second filtered signal to generate a fifth filtered signal;

a sixth filter circuit for filtering the first input signal to generate a sixth filtered signal;

a seventh filter circuit for filtering the feedback signal to generate a seventh filtered signal; and a control circuit, coupled to the fourth filter circuit, the fifth filter circuit, the sixth filter circuit, and the seventh filter circuit, for updating the first scale and the second scale according to the fourth filtered signal, the fifth filtered signal, and the feedback signal, and updating the first filter coefficient and the second filter coefficient according to the sixth filtered signal, the seventh filtered signal, the feedback signal, the first scale, and the second scale.

5. The sound input and output system of claim 2, further comprising:

a first down-sampler for down-sampling the first filtered signal to generate a first down-sampled signal;

a fourth filter circuit, coupled to the first down-sampler, for filtering the first down-sampled signal to generate a fourth filtered signal;

a second down-sampler for down-sampling the second filtered signal to generate a second down-sampled signal;

a fifth filter circuit, coupled to the second down-sampler, for filtering the second down-sampled signal to generate a fifth filtered signal;

a third down-sampler for down-sampling the feedback signal to generate a third down-sampled signal;

a sixth filter circuit, coupled to the third down-sampler, for filtering the third down-sampled signal to generate a sixth filtered signal;

a fourth down-sampler for down-sampling the first input signal to generate a fourth down-sampled signal;

a seventh filter circuit, coupled to the fourth down-sampler, for filtering the fourth down-sampled signal to generate a seventh filtered signal;

a control circuit, coupled to the fourth filter circuit, the fifth filter circuit, the third down-sampler, the sixth filter circuit, and the seventh filter circuit, for generating a first down-sampled scale and a second down-sampled scale according to the fourth filtered signal, the fifth filtered signal, and the third down-sampled signal, and generating a first down-sampled filter coefficient and a second down-sampled filter coefficient according to the sixth filtered signal, the seventh filtered signal, the third down-sampled signal, the first down-sampled scale, and the second down-sampled scale; and a conversion circuit, coupled to the control circuit, for converting the first down-sampled scale, the second down-sampled scale, the first down-sampled filter coefficient, and the second down-sampled filter coefficient into the first scale, the second scale, the first filter coefficient, and the second filter coefficient, respectively.

6. The sound input and output system of claim 1, wherein the signal processing circuit comprises:

a third filter circuit for filtering the audio signal to generate a third filtered signal;

a third adder circuit, coupled to the third filter circuit, for subtracting the third filtered signal from the second input signal to generate a third intermediate signal;

a fourth filter circuit for filtering the noise cancellation signal to generate a fourth filtered signal; and a fourth adder circuit, coupled to the second filter circuit, the third adder circuit, and the fourth filter circuit, for subtracting the fourth filtered signal from the third intermediate signal to generate the feedback signal.

7. The sound input and output system of claim 6, further comprising:

a scale update circuit, coupled to the first filter circuit, the second filter circuit, the signal processing circuit, the first multiplication circuit, and the second multiplication circuit, for updating the first scale and the second scale according to the first filtered signal, the second filtered signal, and the third intermediate signal; and a filter coefficient update circuit, coupled to the signal processing circuit, the first filter circuit, and the second filter circuit, for updating the first filter coefficient and the second filter coefficient according to the first input signal, the third intermediate signal, the feedback signal, the first scale, and the second scale.

8. The sound input and output system of claim 1, wherein a sum of the first scale and the second scale is one.

9. The sound input and output system of claim 8, further comprising:

a third adder circuit, coupled to the first filter circuit and the second filter circuit, for subtracting the second filtered signal from the first filtered signal to generate a difference signal;

a third filter circuit, coupled to the third adder circuit, for filtering the difference signal to generate a third filtered signal; and a control circuit, coupled to the third filter circuit, for updating one of the first scale and the second scale according to the third filtered signal and the feedback signal.

10. The sound input and output system of claim 8, further comprising:

a third adder circuit, coupled to the first filter circuit and the second filter circuit, for subtracting the second filtered signal from the first filtered signal to generate a difference signal;

a first down-sampler, coupled to the third adder circuit, for down-sampling the difference signal to generate a first down-sampled signal;

a third filter circuit, coupled to the first down-sampler, for filtering the first down-sampled signal to generate a third filtered signal;

a second down-sampler, coupled to the signal processing circuit, for down-sampling the feedback signal to generate a second down-sampled signal;

a control circuit, coupled to the third filter circuit and the second down-sampler, for generating a down-sampled scale according to the third filtered signal and the second down-sampled signal; and a conversion circuit, coupled to the control circuit, for converting the down-sampled scale into the first scale.

11. A noise cancellation circuit for processing an audio signal and generating an output signal, comprising:

a first filter circuit for filtering a first input signal according to a first filter coefficient to generate a first filtered signal;

a signal processing circuit for generating a feedback signal according to a second input signal and the audio signal, wherein the signal processing circuit filters the audio signal to generate a filtered audio signal, and the feedback signal comprises a calculation result of the filtered audio signal and the second input signal;

a second filter circuit, coupled to the signal processing circuit, for filtering the feedback signal according to a second filter coefficient to generate a second filtered signal;

a first multiplication circuit, coupled to the first filter circuit, for multiplying the first filtered signal by a first scale to generate a first intermediate signal;

a second multiplication circuit, coupled to the second filter circuit, for multiplying the second filtered signal by a second scale to generate a second intermediate signal;

a first adder circuit, coupled to the first multiplication circuit and the second multiplication circuit, for adding the first intermediate signal to the second intermediate signal to generate a noise cancellation signal; and a second adder circuit, coupled to the first adder circuit, for adding the noise cancellation signal to the audio signal to generate the output signal.

12. The noise cancellation circuit of claim 11, wherein the signal processing circuit comprises:

a third filter circuit for filtering the audio signal to generate a third filtered signal; and a third adder circuit, coupled to the third filter circuit, for subtracting the third filtered signal from the second input signal to generate the feedback signal.

13. The noise cancellation circuit of claim 12, further comprising:

a scale update circuit, coupled to the first filter circuit, the second filter circuit, the signal processing circuit, the first multiplication circuit, and the second multiplication circuit, for updating the first scale and the second scale according to the first filtered signal, the second filtered signal, and the feedback signal; and a filter coefficient update circuit, coupled to the signal processing circuit, the first filter circuit, and the second filter circuit, for updating the first filter coefficient and the second filter coefficient according to the first input signal, the feedback signal, the first scale, and the second scale.

14. The noise cancellation circuit of claim 12, further comprising:

a fourth filter circuit for filtering the first filtered signal to generate a fourth filtered signal;

a fifth filter circuit for filtering the second filtered signal to generate a fifth filtered signal;

a sixth filter circuit for filtering the first input signal to generate a sixth filtered signal;

a seventh filter circuit for filtering the feedback signal to generate a seventh filtered signal; and a control circuit, coupled to the fourth filter circuit, the fifth filter circuit, the sixth filter circuit, and the seventh filter circuit, for updating the first scale and the second scale according to the fourth filtered signal, the fifth filtered signal, and the feedback signal, and updating the first filter coefficient and the second filter coefficient according to the sixth filtered signal, the seventh filtered signal, the feedback signal, the first scale, and the second scale.

15. The noise cancellation circuit of claim 12, further comprising:

a first down-sampler for down-sampling the first filtered signal to generate a first down-sampled signal;

a fourth filter circuit, coupled to the first down-sampler, for filtering the first down-sampled signal to generate a fourth filtered signal;

a second down-sampler for down-sampling the second filtered signal to generate a second down-sampled signal;

a fifth filter circuit, coupled to the second down-sampler, for filtering the second down-sampled signal to generate a fifth filtered signal;

a third down-sampler for down-sampling the feedback signal to generate a third down-sampled signal;

a sixth filter circuit, coupled to the third down-sampler, for filtering the third down-sampled signal to generate a sixth filtered signal;

a fourth down-sampler for down-sampling the first input signal to generate a fourth down-sampled signal;

a seventh filter circuit, coupled to the fourth down-sampler, for filtering the fourth down-sampled signal to generate a seventh filtered signal;

a control circuit, coupled to the fourth filter circuit, the fifth filter circuit, the third down-sampler, the sixth filter circuit, and the seventh filter circuit, for generating a first down-sampled scale and a second down-sampled scale according to the fourth filtered signal, the fifth filtered signal, and the third down-sampled signal, and generating a first down-sampled filter coefficient and a second down-sampled filter coefficient according to the sixth filtered signal, the seventh filtered signal, the third down-sampled signal, the first down-sampled scale, and the second down-sampled scale; and a conversion circuit, coupled to the control circuit, for converting the first down-sampled scale, the second down-sampled scale, the first down-sampled filter coefficient, and the second down-sampled filter coefficient into the first scale, the second scale, the first filter coefficient, and the second filter coefficient, respectively.

16. The noise cancellation circuit of claim 11, wherein the signal processing circuit comprises:

a third filter circuit for filtering the audio signal to generate a third filtered signal;

a third adder circuit, coupled to the third filter circuit, for subtracting the third filtered signal from the second input signal to generate a third intermediate signal;

a fourth filter circuit for filtering the noise cancellation signal to generate a fourth filtered signal; and a fourth adder circuit, coupled to the second filter circuit, the third adder circuit, and the fourth filter circuit, for subtracting the fourth filtered signal from the third intermediate signal to generate the feedback signal.

17. The noise cancellation circuit of claim 16, further comprising:

a scale update circuit, coupled to the first filter circuit, the second filter circuit, the signal processing circuit, the first multiplication circuit, and the second multiplication circuit, for updating the first scale and the second scale according to the first filtered signal, the second filtered signal, and the third intermediate signal; and a filter coefficient update circuit, coupled to the signal processing circuit, the first filter circuit, and the second filter circuit, for updating the first filter coefficient and the second filter coefficient according to the first input signal, the third intermediate signal, the feedback signal, the first scale, and the second scale.

18. The noise cancellation circuit of claim 11, wherein a sum of the first scale and the second scale is one.

19. The noise cancellation circuit of claim 18, further comprising:

a third adder circuit, coupled to the first filter circuit and the second filter circuit, for subtracting the second filtered signal from the first filtered signal to generate a difference signal;

a third filter circuit, coupled to the third adder circuit, for filtering the difference signal to generate a third filtered signal; and a control circuit, coupled to the third filter circuit, for updating one of the first scale and the second scale according to the third filtered signal and the feedback signal.

20. The noise cancellation circuit of claim 18, further comprising:

a third adder circuit, coupled to the first filter circuit and the second filter circuit, for subtracting the second filtered signal from the first filtered signal to generate a difference signal;

a first down-sampler, coupled to the third adder circuit, for down-sampling the difference signal to generate a first down-sampled signal;

a third filter circuit, coupled to the first down-sampler, for filtering the first down-sampled signal to generate a third filtered signal;

a second down-sampler, coupled to the signal processing circuit, for down-sampling the feedback signal to generate a second down-sampled signal;

a control circuit, coupled to the third filter circuit and the second down-sampler, for generating a down-sampled scale according to the third filtered signal and the second down-sampled signal; and a conversion circuit, coupled to the control circuit, for converting the down-sampled scale into the first scale.

* * * * *